US005377570A

United States Patent [19]

Giljam

[11] Patent Number: 5,377,570

[45] Date of Patent: Jan. 3, 1995

[54] APPARATUS FOR PERFORATING PLASTIC FILM SADDLE BAGS

[75] Inventor: Kenneth J. Giljam, Nashville, Tenn.

[73] Assignee: Packaging Innovations, Inc., Nashville, Tenn.

[21] Appl. No.: 961,478

[22] Filed: Oct. 15, 1992

[51] Int. Cl.[6] ..... B31B 31/14

[52] U.S. Cl. ..... 83/175; 83/255; 83/278; 83/461; 493/204; 493/238

[58] Field of Search ..... 83/171, 175, 176, 277, 83/278, 255, 461; 493/204, 227, 238, 239

[56] References Cited

U.S. PATENT DOCUMENTS

| | | | |
|---|---|---|---|
| 3,724,340 | 4/1973 | Brockmuller . | |
| 3,739,694 | 6/1973 | Davis, Jr. . | |
| 3,803,963 | 4/1974 | Hunt | 83/175 X |
| 3,992,966 | 11/1976 | D'Agostino | 83/175 |
| 4,004,481 | 1/1977 | van den Beld . | |
| 4,305,503 | 12/1981 | Membrino . | |
| 4,308,021 | 12/1981 | Achelpohl | 493/204 X |
| 4,332,578 | 6/1982 | van der Meulen . | |
| 4,451,249 | 5/1984 | deBin | 493/204 |
| 4,485,466 | 7/1984 | Carbone et al. . | |
| 4,488,466 | 12/1984 | Jones | 83/175 |
| 4,662,864 | 5/1987 | Lehmacher | 493/204 |
| 4,733,780 | 3/1988 | Jensen . | |
| 4,758,214 | 7/1988 | deBin | 83/171 X |
| 4,769,125 | 9/1988 | Roen et al. . | |
| 4,852,442 | 8/1989 | Pottorff . | |
| 5,001,956 | 3/1991 | Nitsch . | |
| 5,062,716 | 11/1991 | Conrad et al. . | |
| 5,100,000 | 3/1992 | Huseman . | |

FOREIGN PATENT DOCUMENTS

| | | | |
|---|---|---|---|
| 1806784 | 5/1970 | Germany | 83/175 |

*Primary Examiner*—Rinaldi J. Rada
*Attorney, Agent, or Firm*—George Pappas

[57] ABSTRACT

An apparatus and method for perforating a plastic film fleader section connecting together a plurality of plastic film bags and forming a pack of saddle bags. The saddle bags are carried on a block with the header on the block and the bags draped thereover. The block is in sliding engagement with a track and is selectively moved in position in the apparatus. A pair of pivotally connected arms are selectively pivotally moved in contact with the plastic film bags pulling the bags generally away from the header and causing the header to become taut. A pair of perforation blades are forced toward the carrying block and through the header simultaneously creating two perforation lines, one line on each side of the header.

16 Claims, 4 Drawing Sheets

APPARATUS FOR PERFORATING PLASTIC FILM SADDLE BAGS

TECHNICAL FIELD

The present invention relates to the technical field of manufacturing plastic film saddle bags. More specifically, the present invention relates to an apparatus and a method wherethrough the plastic film header section connecting together a plurality of plastic film bags and forming a pack of saddle bags may be perforated in a manner whereby the plastic film bags can, thereafter, be detached from the header at the perforation by pulling the bags away from the header.

BACKGROUND OF THE INVENTION

Plastic film bags are now commonly used for placing therein and storing foodstuff, mechanical components such as nuts, bolts, etc., and for a myriad of other items. For delis and other facilities where these plastic film bags are used, a pack of bags is normally attached together at a header such as by a heated needle and a perforation is provided between the header and each plastic film bag. The pack of bags is hung or otherwise attached to a wall or other carrying device and as the bags are needed, the operator merely grabs and pulls each bag away from the header thereby detaching the plastic film bag from the header.

Plastic film bag packs are also manufactured in what is commonly referred to as a "saddle pack". Here, a common header is used and a plurality of plastic film bags extend away from the header on two sides of the header. A perforation is provided on both sides of the header and inbetween each side of the plastic film bags and the header. With a saddle pack of plastic film bags, the header is attached or otherwise hung on a carrying device in a manner whereby the plastic film bags drape over both sides of the carrying device. Thus, the operator may grasp and pull away plastic film bags from both sides of the header.

As can be appreciated, it is important that the perforation between the header and each of the plastic film bags be of the same strength so that the operator can consistently use substantially the same pulling force for tearing each bag away from the pack. In this fashion, the operator tends to "memorize" the pulling force required and, thus, the speed and consistency of properly pulling the bag away from the header is enhanced. In addition, if the perforation is made improperly such as too strong, it is possible that the bags can be damaged when torn away from the header. On the other hand, if the perforation is made too weak, more than one bag may fall off the header by for example, frictional forces when a single bag is grasped and pulled away therefrom.

Accordingly, a need exists for an apparatus and method of efficiently and accurately perforating a plastic film header section connecting together a plurality of plastic film bags and wherein the created perforation is substantially the same throughout the pack.

SUMMARY OF THE INVENTION

It is the principal object of the present invention to overcome the above-discussed disadvantages associated with prior apparatuses and methods for perforating plastic film header sections connecting together plastic film bags.

The present invention overcomes the disadvantages associated with prior perforation apparatuses and methods by providing a carrying block whereby the pack of bags are carried with the plastic film header on the carrying block and the plastic film bags draped thereover. The carrying block is in sliding engagement with a track and an air cylinder or a conveyor belt/chain is connected to the carrying block and indexes or moves the carrying block along with the pack of bags along the track.

A single arm or two arms, in the case of saddle bags, are provided and each have a contact pad. The arms are adapted for pivotal movement in and out of contact with the plastic film bags. The arms are caused to selectively pivot by an air cylinder connected thereto and thereby causing the contact pads to come in contact with the plastic film bags pull the bags generally away from the header and thus causing the header to become taut. Preferably, the arms are located with respect to the plastic film bags for providing both a horizontal and a vertical downward force after the contact pad first contacts the bags and thereby pulling the bags generally away from the header and making the header taut.

One or two perforation blades, in the case of saddle bags, are carried on a mounting block which is connected to an air cylinder adapted for forcing the mounting block and perforation blades through the header. The perforation blades include knife cut-through sections for cutting through an edge of the header and completely severing the header edge. The carrying block is provided with one or two knife receiving slots, depending on nhe number of perforation blades, adapted for receiving the perforation blades when they are forced through the header.

In one form thereof, the present invention is directed to an apparatus for perforating a plastic film header section connecting together a plurality of plastic film bags and forming a pack of bags. The apparatus includes a means for carrying the pack of bags at the plastic film header with the plastic film bags draped thereover and a means for making the plastic film header section taut on the carrying means. Perforation means is also provided for partially cutting the plastic film header section and perforating it, whereby the plastic film bags can thereafter be detached from the header at the perforation by pulling the bags away from the header.

In one form thereof, the present invention is directed to an apparatus for perforating a plastic film header section connecting together a plurality of plastic film bags and forming a pack of saddle bags. The apparatus includes a carrying block whereover the plastic film bags are draped. The carrying block is in sliding engagement with a track and a means is provided for moving the block on the track. Two arms, each having a contact pad, are provided and are adapted for pivotal movement in and out of contact with the plastic film bags. The arms are pivotally movable for selectively making the pads contact the bags whereby the plastic film header section is made taut on the carrying block. Two perforation blades are provided and are carried by a means for forcing the blades through the header and simultaneously creating two perforation lines, one on each side of the header.

In one form thereof, the present invention is directed to a method of perforating a plastic film header section connecting together a plurality of plastic film bags and forming a pack of bags. The method includes carrying the pack of bags on a carrying block with the plastic film header on the carrying block and the plastic film bags draped thereover. Thereafter, the plastic film header is made taut on the carrying block and the header section is perforated in a manner whereby the plastic film bags can, thereafter, be detached from the header at the perforation by pulling the bags away from the header.

BRIEF DESCRIPTION OF THE DRAWINGS

The above-mentioned and other features and objects of this invention and the manner of obtaining them will become more apparent and the invention itself will be better understood by reference to the following description of embodiments of the invention, taken in conjunction with the accompanying drawings wherein.

Corresponding reference characters indicate corresponding parts throughout the several views of the drawings.

Figure 1:
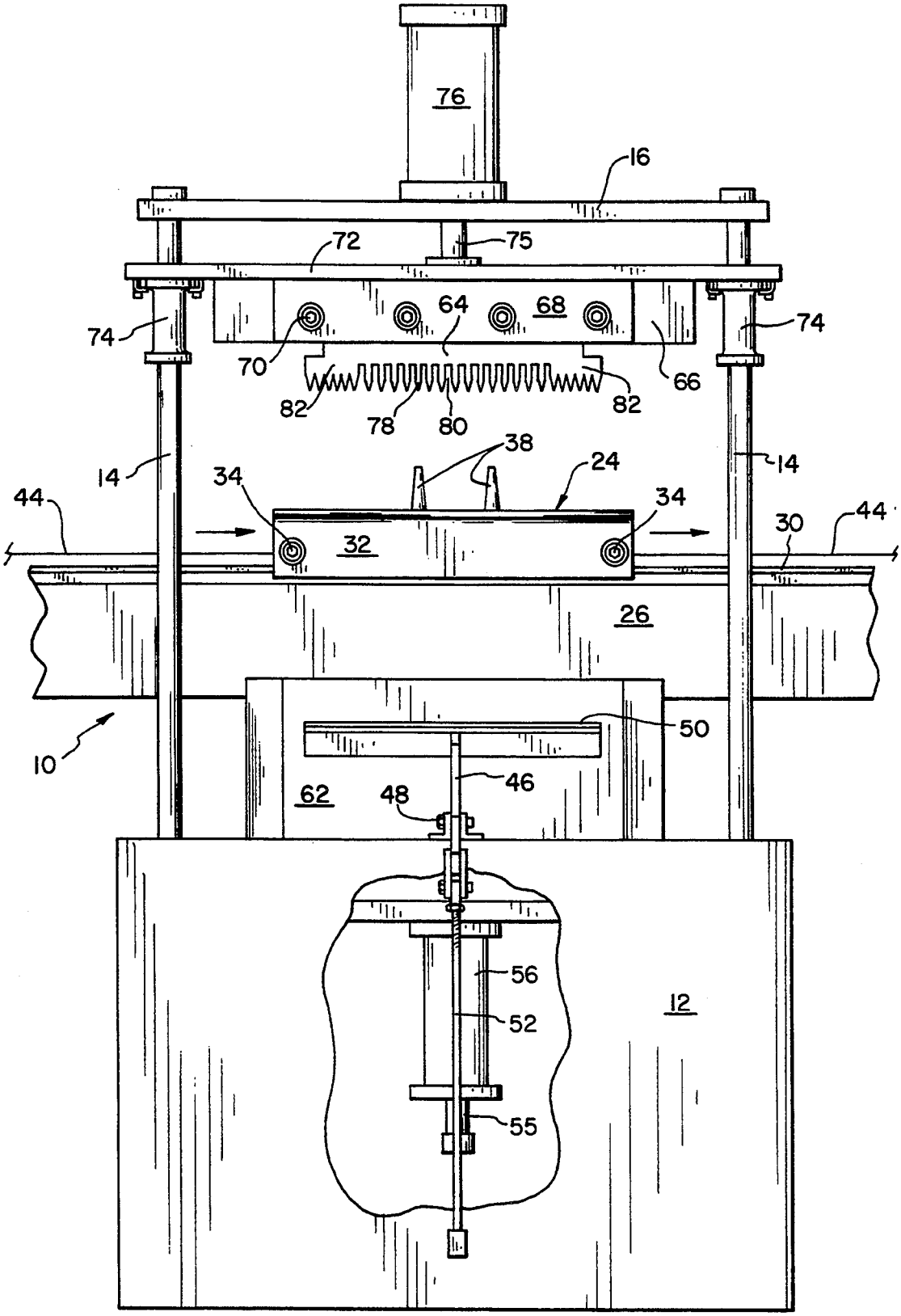
FIG. 1 is a side elevational view of the apparatus according to the present invention.

The exemplifications set out herein illustrate preferred embodiments of the invention in one form thereof and such exemplifications are not to be construed as limiting the scope of the disclosure or the scope of the invention in any manner.

DETAILED DESCRIPTION OF SPECIFIC EMBODIMENTS

Referring to the drawings, an apparatus for perforating a plastic film header section is designated by the numeral 10. The apparatus includes a base 12 supporting four vertical members 14 which, in turn, are rigidly connected to and support a ceiling section 16.

A pack of plastic film bags 18 are moved through apparatus 10 for creating a perforation line through header 20. The pack of bags 18 are moved through apparatus 10 with a conveyor generally designated as 22. Conveyer 22 includes a carrying block 24 setting on and in sliding engagement with a track 26. More specifically, carrying block 22 includes a C-shaped member 28 engaging T-shaped portion 30 of track 26 for thereby being retained and sliding thereon. Carrying block 24 further includes side walls 32 affixed to carrying block 24 via bolts 34. Side walls 32 are chamfered on one end thereof thereby creating perforation knife receiving slots 36 between side walls 32 and carrying block 24.

Carrying block 24 is provided with posts 38 which are attached thereto and extend generally vertically upwardly. Posts 38 are adapted to and correspond with header holes 40 in the header 20. Thus, pack 18 is carried on and moves along with carrying block 24 when header 20 rests thereon and posts 38 are received through the corresponding header holes 40.

In a first embodiment, carrying block 24 is caused to move on track 26 through the use of an air cylinder 42 and extension arm 43 connected to block 24. In a second embodiment, as shown in FIG. 1, a conveyor belt 44 is connected to carrying block 24 and provides the necessary forces on carrying block 24 for moving the same on track 26. In both of these embodiments, the conveyor belt 44 and air cylinder 42 are selectively controlled to move carrying block 24 in a precise location within apparatus 10 for accomplishing the perforation step as more fully discussed hereinbelow.

After the pack of bags or saddle bags 18 are placed on carrying block 24 and carrying block 24 is slid on track 26 into position as shown in the drawings, the header 20 is made taut so that it may, thereafter, be perforated. In this regard, arms 46 are pivotally attached to base 12 with pivot pins 48 and are selectively adapted to pivot thereabout as shown by the curved dashed lines. Arms 46 at one end are provided with a contact pad 50 preferably made of a rubber material. At the other end thereof, arms 46 are pivotally connected to push/pull rods 52 which are, in turn, pivotally connected to teeter totter arms 54. At the other end thereof, teeter totter arms 54 are pivotally connected to extension arm 55 of air cylinder 56 which is adapted to move vertically up and down as indicated by the arrows and causing arms 54 to teeter totter about pivot points 58. It should be noted that the connection between air cylinder 56 and extension arm 55 allows arms 54 to slide generally horizontally as needed to accommodate the lengths of arms 54 as air cylinder 56 selectively pushes or pulls. Accordingly, as arms 54 are caused to selectively teeter totter, rods 52 move vertically up and down as shown by the arrows and provide the necessary forces for causing arms 46 to pivot about pivot pins 48.

Figure 2:
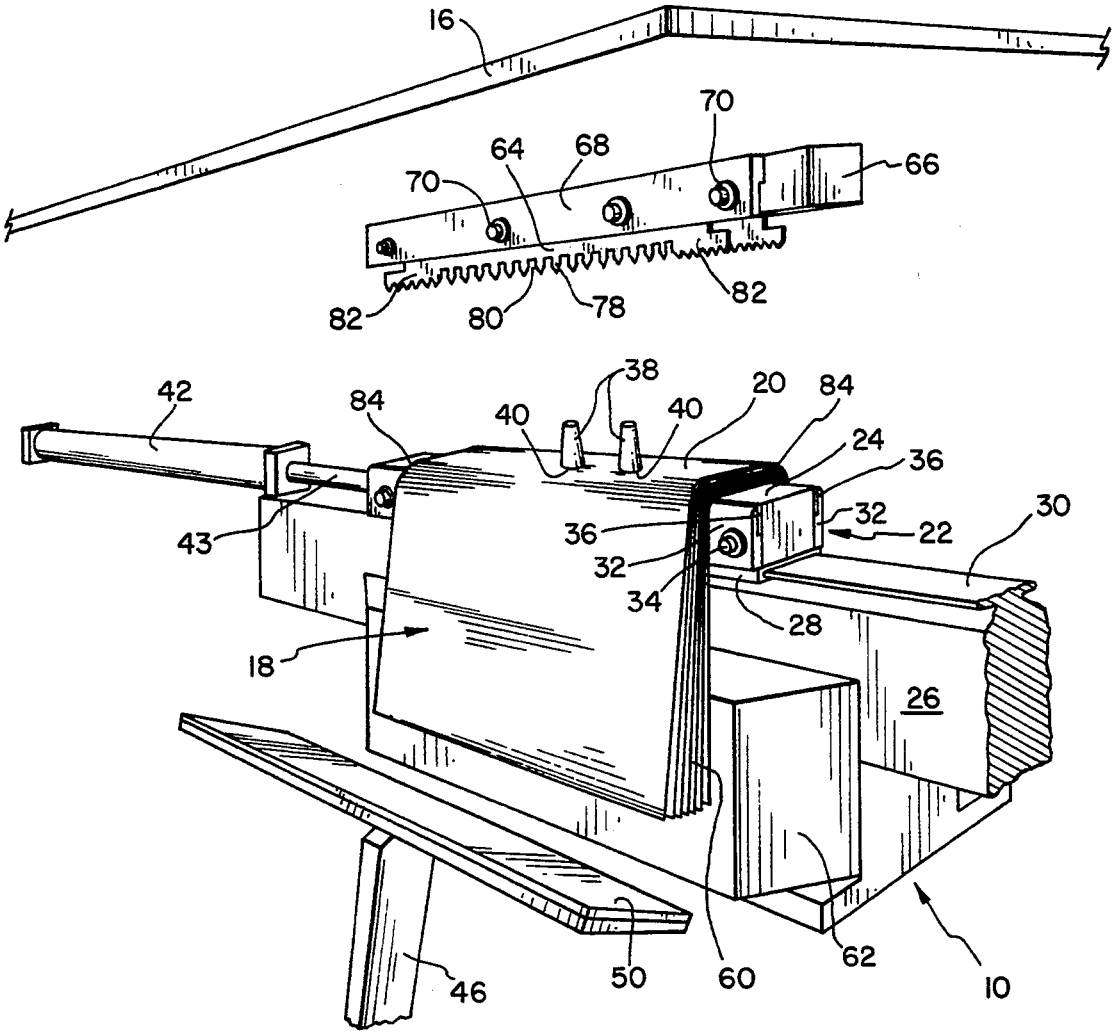
FIG. 2 is a perspective partial view of the apparatus shown in FIG. 1 and showing saddle bags draped over the carrying block.

Pivot pins 48 and, thus, the pivotal connection of arms 46 are located on base 12 a particular distance from track 26 and also, a pack of bags 18 carried thereon so that the plastic film bags 60 draped over carrying block 24 may be pulled away from header 20 making header 20 taut. In this regard, shock absorption blocks 62 are provided on both sides of track 26 and are preferably made of wood, rubber, or other shock-absorbing material. As plastic film bags 60 of pack 18 are moved into position, the plastic film bags 60 overly shock absorption blocks 62 as more clearly shown in FIGS. 3 and 4. Prior to arms 46 being pivoted in contact with bags 60, as shown in FIG. 2, the pack of bags tend to be "fluffy" or the pack is generally thicker with air inbetween the bags. As arms 46 are simultaneously caused to pivot bringing contact pads 50 toward shock absorption blocks 62, contact pads 50 first contact the outermost plastic film bag of the pack 18 at a point further away than a distance equal to the net thickness of all the bags 60 of pack 18 when compressed. Thus, each contact pad 50 first frictionally comes in contact with the first plastic film bag and pushes that first plastic film bag along with the bags thereunder both vertically downwardly and horizontally toward the absorption blocks 62. In this fashion, the plastic film bags 60 are pulled generally away from header 20 and, thus, causing header 20 to become taut on top of carrying block 24.

Figure 3:
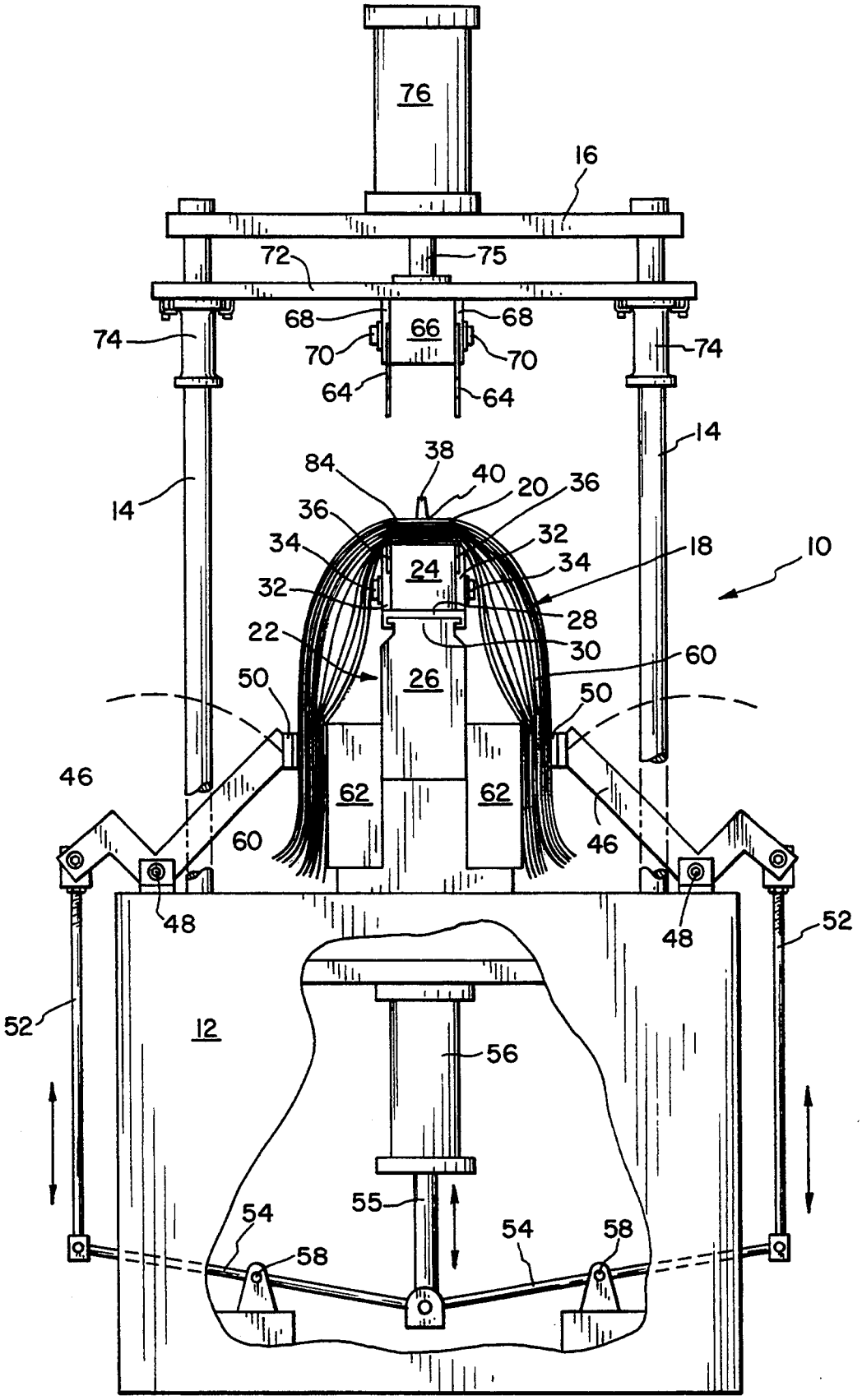
FIG. 3 is a front elevational view of the apparatus shown in FIG. 1 and showing two arms pivoted in contact with the saddle bags; and, FIG. 4 is a side elevational view of the apparatus shown in FIG. 1 and showing the perforation blades in cutting engagement with the saddle bag header.

After arms 46 are pivoted onto plastic film bags 60 as shown in FIG. 3, and the plastic film bags are pinched and held in place between contact pads 50 and absorption blocks 62 as described hereinabove, the header 20 is ready to be perforated. In this regard, apparatus 10 includes perforation blades 64 carried on a mounting block 66. Perforation blades 64 are affixed to mounting block 66 with plates 68 and bolts 70 by sandwiching blades 64 between plates 68 and block 66 and tightening bolts 70 thereon.

Mounting block 66 is, in turn, affixed and carried on floor 72. Four cylindrical members 74 are affixed to floor 72 and each of the cylindrical members 74 receive therethrough, in sliding engagement, one of the vertical members 14. Thus, floor 72 is adapted to slidingly move on vertical members 14 vertically upwardly and downwardly.

Figure 4:
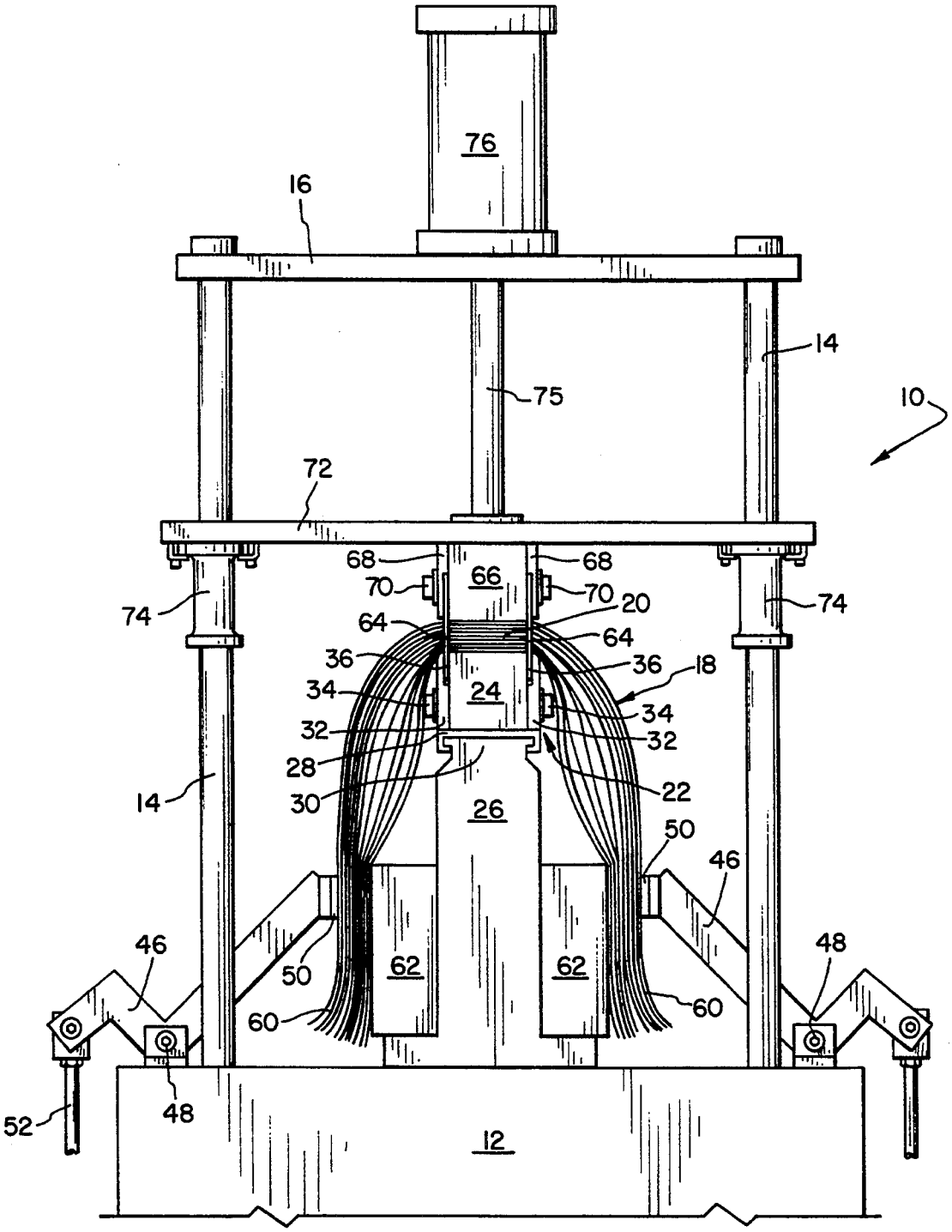

Floor 72 and, thus, perforation blades 64 are selectively caused to move upwardly and downwardly via extension arm 75 of air cylinder 76 which is carried by ceiling section 16. Air cylinder extension arm 75 is connected to floor 72 and, thus, mounting block 66 and perforation blades 64 are selectively forced downwardly through header 20 as shown in FIG. 4. After header 20 is perforated, air cylinder 76 is caused to retract thus pulling perforation blades 64 along with floor 72 in the retracted position as shown in FIGS. 1 and 3.

As more clearly shown in FIGS. 1 and 2, perforation blades 64 include a plurality of pointed teeth 78 defining gaps 80 therebetween. Thus, as each perforation blade 64 is forced onto header 20, the header is cut only by teeth 78 leaving the plastic film therebetween and within gaps 80 uncut. Perforation blades 64 are provided at each end thereof with knife cut through sections 82. Sections 82 do not include gaps such as 80 and are adapted for cutting completely through header 20. Furthermore, a sufficient length of teeth 78 are provided and sections 82 are spaced in a manner whereby the edges 84 of header 20 are cut through. Perforation blades are made of hardened steel and are sharpened in a known and customary manner for cutting header 20 which is made of overlying plastic film. Perforation blades 64 need not be heated for properly cutting and perforating the header 20.

As more clearly shown in FIG. 4, when perforation blades 64 are forced through header 20, teeth 78 and sections 82 thereof are received within slots 36 and are, thus, not damaged. Also, in the embodiment as shown in FIG. 4, two perforation lines are made, one on each side of header 20. It is also noted that mounting block 66 is provided with post-receiving bores (not shown) for receiving posts 38 when block 66 is forced downwardly as shown in FIG. 4.

As can now be seen, in operation, as shown in FIGS. 1 and 2, after a pack of saddle bags 18 are placed on carrying block 24 with posts 38 received through header holes 40, the carrying block is moved into position for perforating the header. As the pack of bags 18 are carried on carrying block 24 with header 20 on block 24 and plastic film bags 18 draped thereover on both sides of track 26, air cylinder 56 is extended thus causing arms 46 to pivot as shown in FIG. 3. Arms 46 thus cause rubber contact pads 50 to come in contact with plastic film bags 60 and pull the plastic film bags generally away from header 20 causing header 20 to become taut.

With arms 46 holding bags 60 as shown in FIG. 3, air cylinder 76 is extended thereby forcing perforation blades 64 downwardly and through header 20 simultaneously creating two perforation lines, one on each side of the header 20. After the perforation blades 64 have cut through the header leaving a perforation between cut through edges 84, air cylinder 76 is caused to retract and pull perforation blades 64 back up in a position as shown in FIG. 3. Then, air cylinder 56 is caused to retract thus causing rods 52 to pull downwardly and pivotally move arms 46 away from plastic film bags 60. Thereafter, carrying block 24 is slidingly moved on track 26 away from arms 46 and perforation blades 64 and so that an operator may grasp the pack of bags or saddle bags 18 pulling them off of carrying block 24 ready for packaging and shipping.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An apparatus for perforating a plastic film header section connecting together a plurality of plastic film bags and forming a pack of bags, said apparatus comprising:

means for carrying the pack of bags at the plastic film header with the plastic film bags draped thereover;

means for contacting a portion of the pack of bags draped over said carrying means and making said plastic film header section taut on said carrying means; and, perforation means for partially cutting the plastic film header section and perforating the same, whereby the plastic film bags can thereafter be detached from the header at said perforation by pulling the bags away from the header.

2. The apparatus of claim 1 wherein said carrying means includes a conveyor adapted to move the pack of bags to and away from said taut means and said perforation means.

3. The apparatus of claim 1 wherein said carrying means includes a carrying block whereover said plastic film bags are draped, said block being in sliding engagement with a track and means for moving said block to and away from said taut means and said perforation means.

4. The apparatus of claim 3 wherein said moving means includes an air cylinder connected to said carrying block and adapted for moving said block on said track.

5. The apparatus of claim 3 wherein said moving means includes a conveyor belt connected to said carrying block and adapted for moving said block on said track.

6. The apparatus of claim 3 wherein the plurality of plastic film bags form a pack of saddle bags and wherein said perforation means includes two perforation blades carried by a means for forcing said blades through the header and simultaneously creating two perforation lines thereat, one line on each side of the header.

7. The apparatus of claim 6 wherein said forcing means includes a mounting block whereupon said perforation blades are carried and an air cylinder connected to said mounting block adapted for forcing said mounting block and perforation blades through the header.

8. The apparatus of claim 6 wherein each of said perforation blades includes knife cut through sections for cutting through an edge of the header.

9. The apparatus of claim 6 wherein said carrying block includes two knife receiving slots, each of said slots aligned with and adapted for receiving one of said perforation blades when said blades are forced through the header.

10. The apparatus of claim 3 wherein said perforation means includes a perforation blade and wherein said carrying block includes a knife receiving slot aligned with and adapted for receiving said perforation blade.

11. The apparatus of claim 3 further including a plurality of posts attached to said carrying block and extending generally vertically upwardly, said posts adapted for being received in corresponding holes in the header.

12. The apparatus of claim 1 wherein the plurality of plastic film bags form a pack of saddle bags and wherein said taut means includes two arms each having a contact pad and adapted for pivotal movement in and out of contact with the plastic film bags, said arms being selectively pivotally movable for making said pads contact the bags.

13. The apparatus of claim 12 wherein said arms are connected to an air cylinder, said air cylinder selectively pivotally moving said arms.

14. The apparatus of claim 12 wherein said contact pad is made of rubber.

15. The apparatus of claim 12 wherein said arms are located with respect to the plastic film bags for providing both a horizontal and a vertical downward force after said contact pads first contact the bags.

16. An apparatus for perforating a plastic film header section connecting together a plurality of plastic film bags and forming a pack of saddle bags, said apparatus comprising:

a carrying block whereover said plastic film bags are draped, said block being in sliding engagement with a track;

means for moving said block on said track;

two arms each having a contact pad and adapted for pivotal movement in and out of contact with the plastic film bags, said arms being pivotally movable for selectively making said pads contact a portion of the pack of bags draped over said carring block whereby the plastic film header section is made taut on the carrying block; and, two perforation blades carried by a means for forcing said blades through the header and simultaneously creating two perforation lines, one on each side of the header.

* * * * *